US010522922B2

(12) United States Patent
Liu et al.

(10) Patent No.: US 10,522,922 B2
(45) Date of Patent: Dec. 31, 2019

(54) ANTENNA SYSTEM

(71) Applicant: AAC Technologies Pte. Ltd., Singapore (SG)

(72) Inventors: Jianchuan Liu, Shenzhen (CN); Mao Liu, Shenzhen (CN); Yuehua Yue, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 86 days.

(21) Appl. No.: 15/869,187

(22) Filed: Jan. 12, 2018

(65) Prior Publication Data

US 2018/0375222 A1 Dec. 27, 2018

(30) Foreign Application Priority Data

Jun. 22, 2017 (CN) ..... 2017 1 0482127

(51) Int. Cl.

| | |
|---|---|
| ***H01Q 21/29*** | (2006.01) |
| ***H01Q 21/06*** | (2006.01) |
| ***H01Q 21/00*** | (2006.01) |
| ***H01Q 1/52*** | (2006.01) |

(52) U.S. Cl.

CPC ..... *H01Q 21/293* (2013.01); *H01Q 1/523* (2013.01); *H01Q 21/0025* (2013.01); *H01Q 21/0075* (2013.01); *H01Q 21/061* (2013.01); *H01Q 21/065* (2013.01)

(58) Field of Classification Search

CPC .. H01Q 21/293; H01Q 1/523; H01Q 21/0025; H01Q 21/0075; H01Q 21/061; H01Q 21/065

See application file for complete search history.

(56) References Cited

U.S. PATENT DOCUMENTS

2019/0131706 A1* 5/2019 Raney ..... H05K 7/20436

* cited by examiner

*Primary Examiner* — Robert J Pascal
*Assistant Examiner* — Kimberly E Glenn
(74) *Attorney, Agent, or Firm* — IPro, PLLC; Na Xu

(57) ABSTRACT

An antenna system includes a feeding point, an antenna array comprising four antenna units and a power division network comprising four power division modules, the antenna array and the power division network are respectively arranged at two opposite planes, one end of each of the four power division modules is respectively connected with one of the four antenna units, and the other ends of the four power division modules are connected with each other and are connected with the feeding point, so as to form a 5G antenna. In the antenna system, the power division network and the antenna array are structured as separate layers to reduce an area of a millimeter wave array formed by the power division network and the antenna array, so that the cellphone can have enough space for the millimeter wave array, thereby reducing difficulties of applying the millimeter wave to a mobile terminal.

10 Claims, 3 Drawing Sheets

ANTENNA SYSTEM

TECHNICAL FIELD

The present disclosure relates to the technical field of antenna system and, in particular, to an antenna system.

BACKGROUND

With the development of communication technologies, in order to keep up with rapid increasing of mobile data flow and various new application scenarios in the future, a system of the fifth generation mobile communication technique (i.e., 5G) will be a developing trend. Moreover, the working frequency band in future mobile communication techniques will continuously approach to millimeter wave. However, the current millimeter wave array is structured to be planar with a large size, which is only suitable to serve as a base station. When the current millimeter wave array is applied to mobile terminals such as cellphone having a limited volume, since such a planar structure will occupy more space, the cellphone may not have enough space to arrange a millimeter wave array. Therefore, it is difficult in the application of millimeter wave to mobile terminal at present.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

REFERENCE SIGNS

Figure 1:
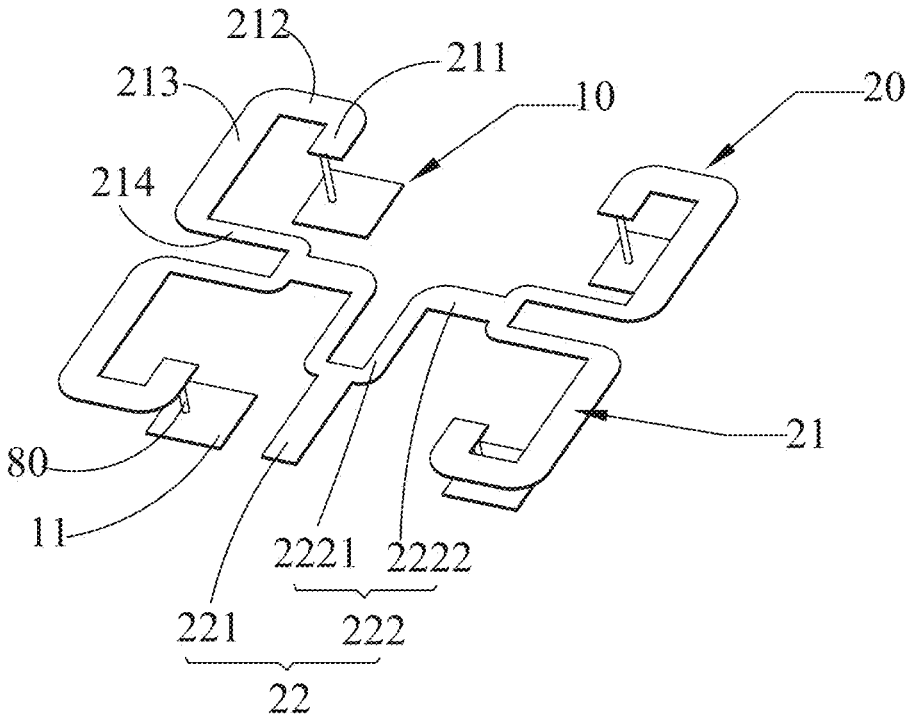
FIG. 1 is a partial structural schematic view of an antenna system in accordance with an exemplary embodiment of the present disclosure.

10—antenna array;
11—antenna unit;
20—power division network;
21—power division module;
211—first module section;
212—second module section;
213—third module section;
214—fourth module section;
22—connecting portion;
221—first connecting section;
222—second connecting section;
2221—first sub-section;
2222—second sub-section;

30—first circuit board;
40—system ground;
50—second circuit board;
60—third circuit board;
70—feeding point;
80—connecting member;
90—isolation resistance.

The drawings are incorporated into the specification and constitute as a part of the specification, which show embodiments of the present disclosure, and are used to explain the principle of the present disclosure together with the specification.

DESCRIPTION OF EMBODIMENTS

The present disclosure will be described in further detail with reference to embodiments and accompanying drawings.

As shown in FIGS. 1-5, an exemplary embodiment of the present disclosure provides an antenna system, which is applicable to mobile terminals such as cellphone, tablet PC and the like. The antenna system includes a feeding point 70, an antenna array 10 and a power division network 20. The antenna array 10 and the power division network 20 are respectively arranged at two opposite planes. Generally, the antenna array 10 and the power division network 20 are arranged by stacking. The antenna array 10 includes four antenna units 11. The power division network 20 includes four power division modules 21, one end of each of the four power division modules 21 is respectively connected with one of the four antenna units 11, and the other ends of the four power division modules 21 are connected with each other and are connected with the feeding point 70. That is, the four power division modules 21 are connected with each other to form a connecting point, and the connecting point of the four power division modules 21 is connected with the feeding point 70. Moreover, each power division module 21 is connected with one corresponding antenna unit 11. A 5G antenna is formed accordingly. It should be noted that, the power division network 20 and the antenna array 10 can use a common system ground.

Through adopting the antenna system as above, the power division network and the antenna array are structured as separate layers, that is, arranged at two different planes, so that an area of a millimeter wave array formed by the power division network and the antenna array can be reduced as much as possible, and thus mobile terminals such a cellphone can have enough space for arranging the millimeter wave array, thereby reducing difficulties of applying the millimeter wave in a mobile terminal. Therefore, it is possible to apply the millimeter wave array to mobile terminals such as cellphone. Such an antenna system has advantages of big gain, long signal transmission distance, and significant improvement on network capacity.

Figure 2:
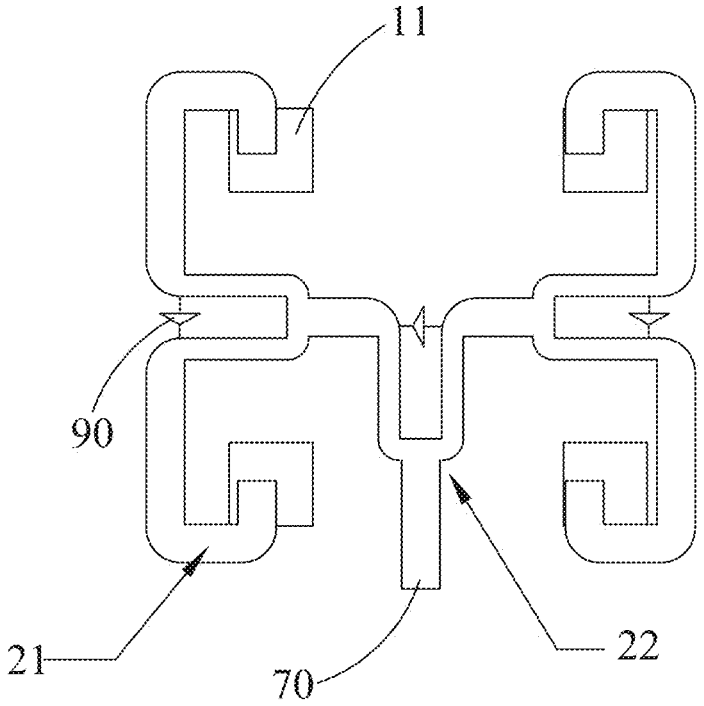
FIG. 2 is a top view of an antenna system in accordance with an exemplary embodiment of the present disclosure.

Specifically, in a group consisting of one antenna unit 11 and one power division module 21 connected with the one antenna unit 11, in a direction along the antenna array 10 toward the power division network 20, the antenna unit 11 is at least partially facing the power division module 21. As shown in FIG. 2, in a group consisting of one antenna unit 11 and one power division module 21 connected with the antenna unit 11, in a direction along the antenna array 10 toward the power division network 20, a projection of the antenna unit 11 is at least partially overlapped with a projection of the power division module 21. Through this structure, the area of the millimeter wave array can be further reduced.

Each power division module 21 includes a first module section 211, a second module section 212, a third module section 213 and a fourth module section 214, and the first module section 211, the second module section 212, the third module section 213 and the fourth module section 214 are successively connected with each other. The first module section 211 is parallel to and spaced from the third module section 213. The second module section 212 is parallel to and spaced from the fourth module section 214. The first module section 211 is spaced from the fourth module section 214. The four power division modules 21 are connected with each other by four tail ends of four fourth module sections 214. Each antenna unit 11 is connected with a tail end of the first module section 211. That is, the first module section 211, the second module section 212, the third module section 213 and the fourth module section 214 are successively connected head to tail, and the first module section 211 is spaced from the fourth module section 214. By this structure, the efficiency of the antenna system can be further improved, which can simplify the structure of the millimeter wave array so as to facilitate its manufacture, thereby improving reliability and maintainability of the system.

The four groups of power division modules 21 and antenna units 11 are distributed in an array of row by column, that is, the four antenna units 11 are arranged in an array of row by column, for example a 2×2 array; correspondingly, the four power division modules 21 can also be arranged in an array of row by column, for example a 2×2 array, so that the distribution of the antenna system is more uniform, thereby further improving efficiency of the antenna system.

As shown in FIG. 1, in the two power division modules 21 of each row, the two first module sections 211 are arranged between the two third module sections 213. In the two power division modules 21 of each column, the two fourth module sections 214 are arranged between the two second module sections 212. Optionally, a tail end of the first module section 211 is spaced from the fourth module section 214, so that each power division module 21 forms a C-shaped structure. Moreover, openings of two power division modules 21 in a same row are opposite to each other, and opening directions of two power division modules 21 in a same column are the same.

The fourth module sections 214 of all the power division modules 21 can be directly connected with each other, and then connected with the feeding point 70. As a result, the tail end of one fourth module section 214 needs to be connected with all three other fourth module sections 214 and also needs to be connected with the feeding point 70, which may reduce the reliability of the connection thereof. In order to facilitate connection between the power division network 20 and the feeding point 70 and, at the same time, guarantee reliability of the connection between the power division network 20 and the feeding point 70 as well as the reliability of the power division network 20 itself, the power division network 20 further includes a connecting portion 22 among the four power division modules 21. The connecting portion 22 includes a first connecting section 221 connected with the feeding point 70, and two second connecting sections 222 which are in parallel connection with each other. One end of one second connecting section 222 is connected with the first connecting section 221, the other end of the one second connecting section 222 is connected with two power division modules 21 located in a same column. As shown in FIG. 1 the first connecting section 221 extends to form two second connecting sections 222, the two second connecting sections 222 corresponds to the two columns of power division modules 21, respectively, so that each second connecting section 222 is connected with two power division modules 21 located in a same column.

Further, the second connecting section 222 includes a first sub-section 2221 and a second sub-section 2222, and the first sub-section 2221 and a second sub-section 2222 are connected head to tail. An end of the first sub-section 2221 away from the second sub-section 2222 is connected with the first connecting section 221, and an end of the second sub-section 2222 away from the first sub-section 2221 is connected with two fourth module sections 214 located in a same column. As a result, the two fourth module sections 214 only need to be connected with the second sub-section 2222, and the first sub-section 2221 is connected with the feeding point 70, so that the number of components to be connected at each connection position can be reduced, thereby better guaranteeing reliability of the connection at each connection position, and thus reliability of the power division network 20 and reliability of the connection between the power division network 20 and the feeding point 70.

Specifically, the first connecting section 221, the second sub-section 2222, the first module section 211, the second module section 212 and the third module section 213 form a first micro-strip transmission line. The first sub-section 2221 and the fourth module section 214 form a second micro-strip transmission line. A characteristic impedance of the first micro-strip transmission line is less than a characteristic impedance of the second micro-strip transmission line. By the arrangement of micro-strip transmission lines having different characteristic impedances, the energy loss during transmission can be reduced, and the transmission power from the feeding point 70 to the antenna unit 11 can be guaranteed. Optionally, the characteristic impedance of the first micro-strip transmission line is 50Ω, which can be implemented by setting a line width of the first micro-strip transmission line as 0.55 mm. The characteristic impedance of the second micro-strip transmission line is 70Ω, which can be implemented by setting a line width of the second micro-strip transmission line as 0.31 mm.

Generally, along a direction from the antenna array 10 toward the power division network 20, a distance between a center of a projection of the feeding point 70 and a center of a projection of one antenna unit 11 is equal to a distance between the center of the projection of the feeding point 70 and a center of a projection of any other antenna unit 11. Therefore, when the center of the projection of the feeding point 70 is defined as a first center, and the center of the projection of each antenna unit 11 is defined as a second center, the distance between the first center and one second center is equal to the distance between the first center and any other second center. As a result, it is guaranteed that phases of signals transmitted from the feeding point 70 to the antenna unit 11 are the same when arriving at the antenna unit 11.

In order to reduce interference between every two power division modules 21, the antenna system further includes an isolating resistance 90. As shown in FIG. 2, the antenna system includes three isolating resistances 90, two second sub-sections 2222 are connected with each other by one isolating resistance 90, and two fourth module sections 214 in each column are connected with each other by one isolating resistance 90 either. Or, the isolating resistance 90 may be provided only between the two fourth module sections 214 in a same column or only between the two second connecting sections 222. A resistance value of the isolating resistance 90 can be 100Ω. It is noted that, the resistance value can also be other values according to actual demands of the antenna system.

The antenna unit 11 can be shaped as a square structure. Since the antenna unit 11 and the power division network 20 are arranged at different planes, in order to facilitate connection therebetween, the antenna system can further includes a connecting member 80. As shown in FIG. 1, the antenna unit 11 is connected with the power division module 21 by the connecting member 80. The connecting member 80 can be a metal post or a conduction wire and the like.

Figure 3:
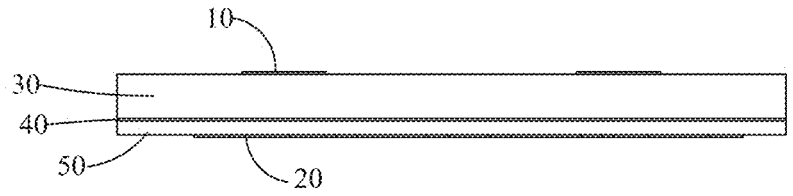
FIG. 3 is a side view of an antenna system in accordance with an exemplary embodiment of the present disclosure.
Figure 4:
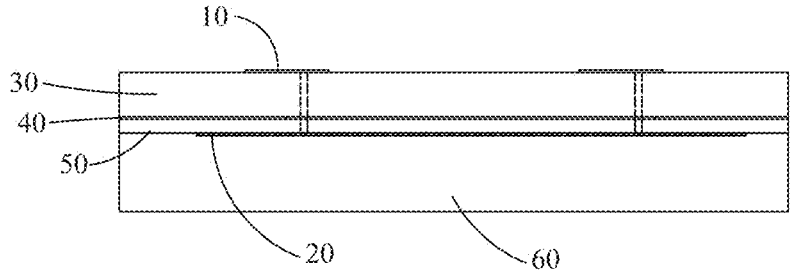
FIG. 4 is a side view of an antenna system in accordance with an exemplary embodiment of the present disclosure.

Optionally, as shown in FIG. 3, the antenna system further includes a first circuit board 30, a system ground 40 and a second circuit board 50 which are arranged by stacking. The four antenna units 11 are arranged at a surface of the first circuit board 30 away from the second circuit board 50. The power division network 20 is arranged at a surface of the second circuit board 50 away from the first circuit board 30. That is to say, the first circuit board 30 is used as a carrier for the antenna array 10, and the second circuit board 50 is used a carrier for the power division network 20, which can improve reliability of the antenna system. When a connecting member 80 is provided, the connecting member 80 can extend through the first circuit board 30, the system ground 40 and the second circuit board 50, so that two ends of the connecting member 80 are respectively connected with the four antenna units 11 and the power division module 21.

In addition, the antenna system further includes a third circuit board 60, then the first circuit board 30, the system ground 40, the second circuit board 50 and the third circuit board 60 are arranged by stacking. Generally, a thickness of the third circuit board 60 is larger than either a thickness of the first circuit board 30 or a thickness of the second circuit board 50. Through adopting the third circuit board 60 as a carrier of the entire antenna array 10 and the power division network 20, the reliability of the antenna system can be further improved.

Figure 5:
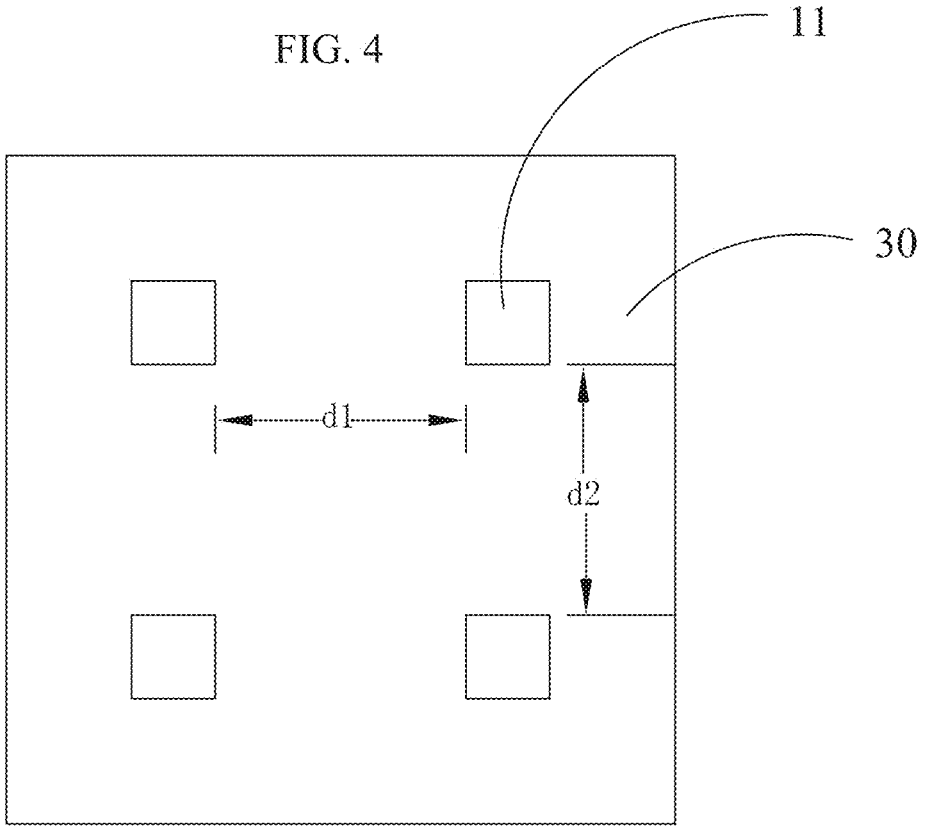
FIG. 5 is a top view of an antenna system in accordance with an exemplary embodiment of the present disclosure.

Generally, in order to guarantee performance of the antenna system, the thickness of the first circuit board 30 is 0.635 mm, the thickness of the second circuit board 50 is 0.2 mm, and the thickness of the third circuit board 60 is 1.33 mm. Optionally, along a direction from the antenna array 10 toward the power division network 20, edges of projections of the first circuit board 30, the system ground 40, the second circuit board 50 and the third circuit board 60 are overlapped, and each of the projections is a square with a size of 9.6 mm×9.6 mm. The projection of each antenna unit 11 is a square with a size of 1.2 mm×1.2 mm. A distance d1 between two antenna units 11 in a same row can be 3.6 mm±0.5 mm, and a distance d2 between two antenna units 11 in a same column can be 3.6 mm±0.5 mm, as shown in FIG. 5.

Figure 6:
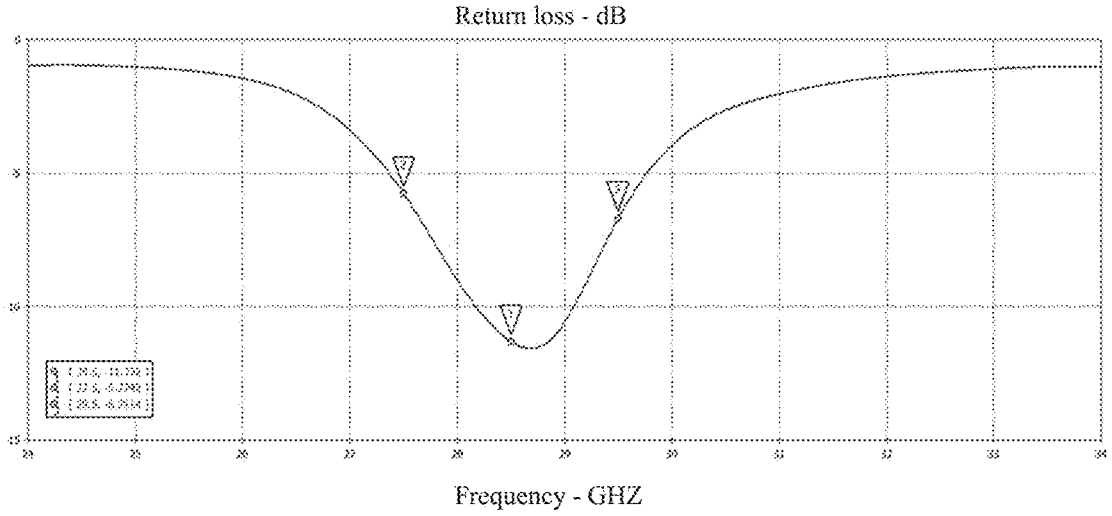
FIG. 6 is a graph showing return loss of an antenna system in accordance with an exemplary embodiment of the present disclosure.
Figure 7:
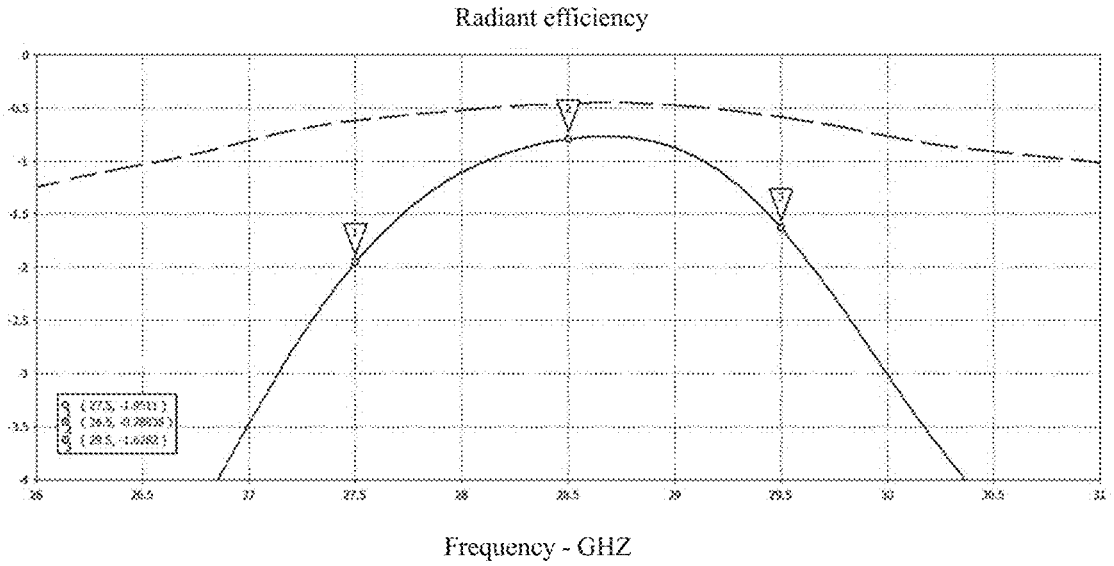
FIG. 7 is a diagram showing radiation efficiency of an antenna system in accordance with an exemplary embodiment of the present disclosure.

The return loss of the above antenna system is as shown in FIG. 6, the radiation efficiency is as shown in FIG. 7.

The present disclosure further provides a mobile terminal, including the antenna system according to any one of the above embodiments.

The above only shows preferred embodiments of the present disclosure, which are not used to limit the present disclosure. For those skilled in the art, the present disclosure can have many modifications and variations. Any modification, equivalent replacement and improvement made within the spirit and principle of the present disclosure shall be included in the protection scope of the present disclosure.

What is claimed is:

1. An antenna system, comprising:

a feeding point;

an antenna array comprising four antenna units; and a power division network comprising four power division modules;

wherein the antenna array and the power division network are respectively arranged at two opposite planes; and wherein one end of each of the four power division modules is respectively connected with one of the four antenna units, and the other end of each of the four power division modules is connected with each other and is connected with the feeding point, so as to form a 5G antenna.

2. The antenna system as described in claim 1, wherein along a direction from the antenna array toward the power division network, in a group consisting of one of the four antenna units and one of the four power division modules connected with each other, the antenna unit is at least partially facing the power division module.

3. The antenna system as described in claim 1, wherein each power division module comprises a first module section, a second module section, a third module section and a fourth module section, the first module section, the second module section, the third module section and the fourth module section are successively connected, the first module section is parallel to and spaced from the third module section, the second module section is parallel to and spaced from the fourth module section, and the first module section is spaced from the fourth module section; the four power division modules are connected with each other by four tail ends of four fourth module sections; and each of the four antenna units is connected with a tail end of the first module section.

4. The antenna system as described in claim 3, wherein the four power division modules and the four antenna units are divided into four groups, each group consists of one of the four power division modules and one of the four antenna units connected with each other, the four groups are distributed in a two-by-two array, each row is set with two power division modules, each column is set with two power division modules, two first module sections of two power division modules in each row are arranged between two third module sections of the two power division modules in the same row, two fourth module sections of two power division modules in each column are arranged between two second module sections of the two power division modules in the same column.

5. The antenna system as described in claim 4, wherein the power division network further comprises a connecting portion arranged among the four power division modules, the connecting portion comprises a first connecting section connected with the feeding point and two second connecting sections which are in parallel connection with each other; one end of each of the two second connecting sections is connected with the first connecting section, and the other end of each of the two second connecting sections is respectively connected with two power division modules in each column.

6. The antenna system as described in claim 4, further comprising:

a circuit board;

a system ground; and a second circuit board;

wherein the circuit board, the system ground and the second circuit board are arranged by stacking, the four antenna units are arranged at a surface of the first circuit board away from the second circuit board; and the power division network is arranged at a surface of the second circuit board away from the first circuit board.

7. The antenna system as described in claim 5, wherein each second connecting section comprises a first sub-section and a second sub-section connected head to tail with the first sub-section, an end of each first sub-section away from the corresponding second sub-section is connected with the first connecting section, and an end of each second sub-section away from the corresponding first sub-section is respectively connected with two fourth module sections of two power division modules in each column.

8. The antenna system as described in claim 7, wherein the first connecting section, the second sub-section, the first module section, the second module section and the third module section form a first micro-strip transmission line; the first sub-section and the fourth module section form a second micro-strip transmission line; and a characteristic impedance of the first micro-strip transmission line is less than a characteristic impedance of the second micro-strip transmission line.

9. The antenna system as described in claim 7, wherein two fourth module sections of two power division modules in each column are connected with each other by one isolating resistance respectively, and two second sub-sections are connected with each other by another isolating resistance.

10. The antenna system as described in claim 1, wherein along a direction from the antenna array to the power division network, a distance between a center of a projection of the feeding point and a center of a projection of each of the four antenna units is equal to each other, so as to guarantee that phases of signals transmitted to each of the four antenna units are identical when the signals arrive at each of the four antenna units.

* * * * *